US007192516B2

(12) United States Patent
Schucker

(10) Patent No.: US 7,192,516 B2
(45) Date of Patent: Mar. 20, 2007

(54) DESULFURIZATION OF PETROLEUM STREAMS USING METALLIC SODIUM

(75) Inventor: Robert C. Schucker, The Woodlands, TX (US)

(73) Assignee: Trans Ionics Corporation, The Woodlands, TX (US)

( * ) Notice: Subject to any disclaimer, the term of this patent is extended or adjusted under 35 U.S.C. 154(b) by 391 days.

(21) Appl. No.: 10/826,621

(22) Filed: Apr. 16, 2004

(65) Prior Publication Data

US 2005/0145545 A1 Jul. 7, 2005

Related U.S. Application Data

(60) Provisional application No. 60/501,343, filed on Sep. 9, 2003, provisional application No. 60/463,703, filed on Apr. 17, 2003.

(51) Int. Cl.
*C10G 29/04* (2006.01)
*C10G 23/00* (2006.01)

(52) U.S. Cl. ..... 208/208 M; 208/14; 208/143; 208/209; 208/230; 208/235

(58) Field of Classification Search ..... 208/14, 208/208 M, 143, 232, 209, 230, 235
See application file for complete search history.

(56) References Cited

U.S. PATENT DOCUMENTS 2,309,651 A * 1/1943 Birkhimer et al. ..... 208/232
3,787,315 A 1/1974 Bearden, Jr. et al.
3,788,978 A 1/1974 Bearden, Jr. et al.
3,791,966 A 2/1974 Bearden, Jr.
3,976,559 A 8/1976 Bearden, Jr. et al.
4,003,824 A 1/1977 Baird, Jr. et al.
4,017,381 A * 4/1977 Baird et al. ..... 208/143
4,076,613 A 2/1978 Bearden, Jr.
4,123,350 A 10/1978 Baird, Jr. et al.
5,948,242 A 9/1999 Ohsol et al.
5,985,137 A 11/1999 Ohsol et al.

(Continued)

OTHER PUBLICATIONS

Z. Yu, et al, "Desulfurization of Organosulfur Compounds with Lithium & Sodium," Energy & Fuels, 1999, vol. 13, No. 1, pp. 23-28.
U. Schindewolf, "Formation and Properties of Solvated Electrons," Angew. Chem. Internat. Edit., 1968, vol. 7, No. 3, pp. 190-203.
H. W. Sternberg, et al, "Reaction of Sodium with Dibenzothiophene. A Method for Desulfurization of Residua," Ind. Eng. Chem., Process Des. Develop., 1974, vol. 13, No. 4, pp. 433-436.

*Primary Examiner*—Glenn Caldarola
*Assistant Examiner*—Prem C. Singh
(74) *Attorney, Agent, or Firm*—Robert C Shaddox; Winstead, Sechrest & Minick P.C.

(57) ABSTRACT

The invention is a method of removing sulfur from a hydrocarbon feed using the steps of dissolving metallic sodium in a solvent and combining the sodium/solvent solution with a liquid hydrocarbon feed containing an organosulfur species. The pressure of combination is above the vapor pressure of the solvent. The combined hydrocarbon feed and solvent solution are placed in a low pressure environment to vaporize the solvent. The resulting stream is combined with hydrogen gas and this stream is heated and pressurized to form a liquid hydrocarbon product containing sodium sulfide. This product is then cooled, and the sodium sulfide is extracted.

23 Claims, 1 Drawing Sheet

U.S. PATENT DOCUMENTS

| | | | |
|---|---|---|---|
| 6,210,564 | B1 | 4/2001 | Brons et al. |
| 6,274,533 | B1 | 8/2001 | Khare |
| 6,338,794 | B1 | 1/2002 | Khare |
| 6,402,939 | B1 | 6/2002 | Yen et al. |
| 6,402,940 | B1 | 6/2002 | Rappas |
| 6,482,314 | B1 | 11/2002 | Khare |
| 6,500,219 | B1 | 12/2002 | Gunnerman |
| 2002/0172871 | A1 | 11/2002 | Schucker |

* cited by examiner

DESULFURIZATION OF PETROLEUM STREAMS USING METALLIC SODIUM

This application claims the priority benefit under 35 USC § 119(e) to provisional patent application No. 60/501,343, filed Sep. 9, 2003, and provisional patent application No. 60/463,703, filed Apr. 17, 2003.

BACKGROUND OF THE INVENTION

1. Brief Description of the Invention

A method has been developed for the desulfurization of a wide range of liquid feeds containing organosulfur compounds using metallic sodium dissolved in liquid ammonia to create highly dispersed sodium for higher efficiency in sulfur removal.

2. Related Art

The literature describes several ways of removing sulfur from petroleum streams, which fall into two primary categories: (a) catalytic hydrotreating processes in which the feed is passed over a hydrotreating catalyst at elevated temperatures and hydrogen pressures and (b) non-hydrotreating processes. The present invention is an improved non-hydrotreating process.

Non-hydrotreating processes can be further divided into those that remove the entire sulfur-bearing molecule from the feed by adsorption onto a selective adsorbent, as exemplified by Khare (U.S. Pat. No. 6,274,533; U.S. Pat. No. 6,338,794 and U.S. Pat. No. 6,482,314), and those that remove only the sulfur by chemical reaction. The latter can further be divided into those that are oxidative in nature, as exemplified by Rappas (U.S. Pat. No. 6,402,940), Ohsol, et al (U.S. Pat. No. 5,985,137; U.S. Pat. No. 5,948,242), Yen (U.S. Pat. No. 6,402,939) and Gunnerman (U.S. Pat. No. 6,500,219), and those that are reducing in nature. The most important of the reducing processes is reaction of a feed containing organosulfur species with elemental sodium as exemplified by Brons, et al (U.S. Pat. No. 6,210,564), Baird (U.S. Pat. No. 4,003,824; U.S. Pat. No. 4,123,350) and Bearden (U.S. Pat. No. 3,787,315; U.S. Pat. No. 3,788,978; U.S. Pat. No. 3,791,966; U.S. Pat. No. 3,976,559 and U.S. Pat. No. 4,076,613).

In order to contact elemental sodium with feed, the sodium is typically melted (m.p.=97.8° C.) and added to the feed as a dispersion of small droplets. Even with intense mixing, it is not possible to produce extremely small droplet sizes. As a result, sodium on the surface of the droplets may react with sulfur in the feed to form a skin of sodium sulfide ($Na_2S$). This skin remains on the droplet exterior surface, and as $Na_2S$ has a melting point of 1,180° C., it remains as a solid under the conditions of desulfurization. The skin thereby inhibits further reaction between the sodium in the interior of the droplet and sulfur in the feed. For these reasons, it has been necessary in the prior art to use substantially higher ratios of sodium to feed sulfur than are stoichiometrically required in order to remove sulfur to the desired level.

3. Summary of the Invention

In accordance with the present invention, a method of removing sulfur from a wide range of liquid feeds is presented which overcomes limitations in the prior art. This invention is a method of removing sulfur from a liquid feed containing organosulfur compounds. The method, in the preferred embodiment, comprises the steps of:

(a) dissolving metallic sodium in a solvent to form a solution of sodium atoms;

(b) combining the resulting liquid solution of sodium with a liquid hydrocarbon feed comprising organosulfur species to form a combined stream at a temperature of addition and at a pressure above the vapor pressure of the solvent at the temperature of addition;

(c) lowering the pressure of the combined stream sufficiently to achieve vaporization of the solvent from the combined stream thereby producing a composition comprising a plurality of finely divided sodium particles dispersed in said hydrocarbon feed;

(d) passing the feed containing the finely divided sodium to a pressurized reactor vessel along with a hydrogen stream comprising a major amount of hydrogen;

(e) reacting the feed and sodium for sufficient time and at sufficient temperature to form a modified composition comprising sodium sulfide and less of the organosulfur species than had been present in the hydrocarbon feed;

(f) cooling the modified composition containing sodium sulfide; and (g) extracting the sodium sulfide from the modified composition using an extraction fluid.

It is readily apparent to those skilled in the art that many different solvents, including but not limited to ammonia and some ethers, may be used to dissolve metallic sodium and that many different reactor and flow configurations may be used to carry out the desulfurization process.

DESCRIPTION OF PREFERRED EMBODIMENTS

Figure 1:
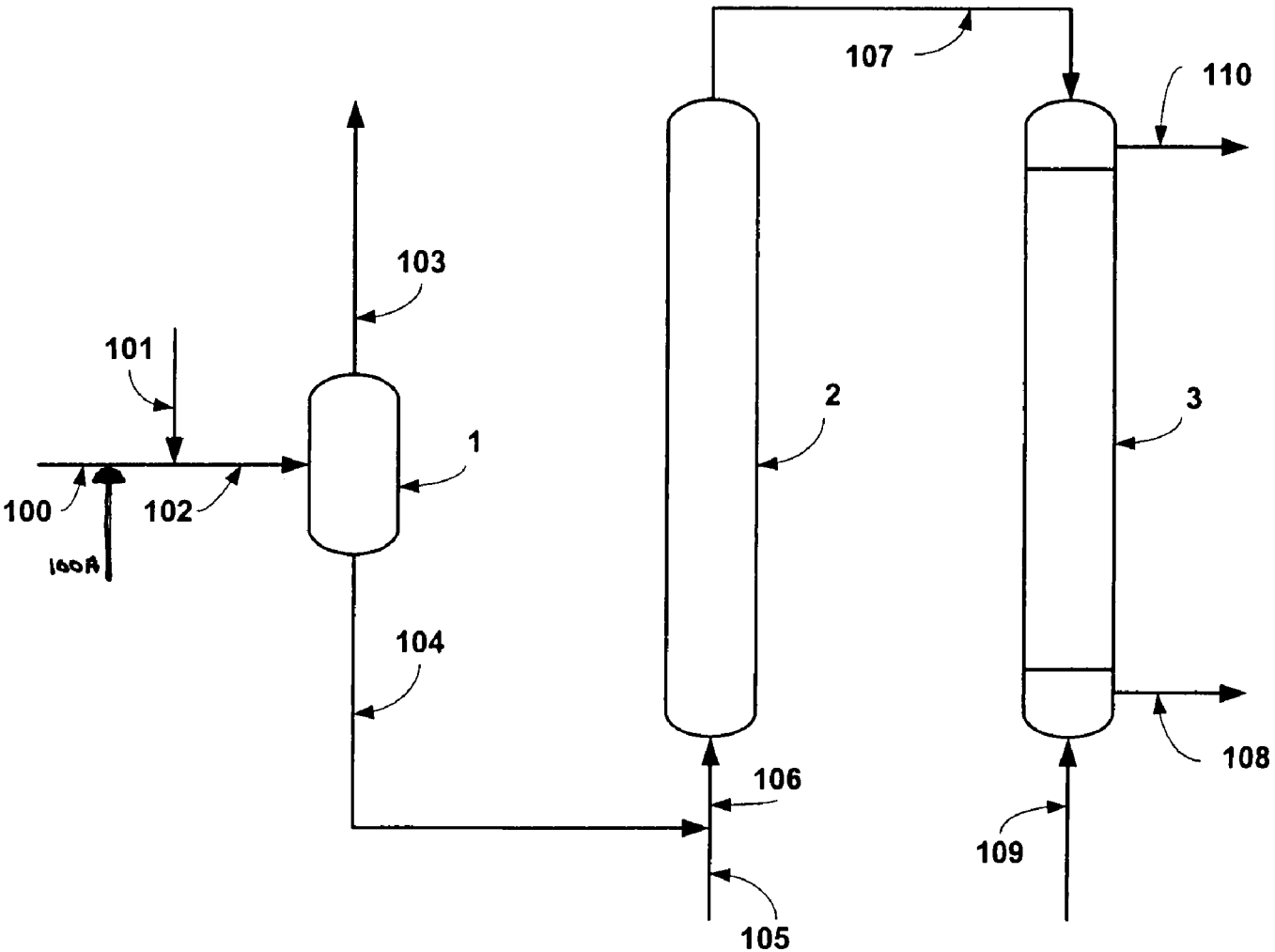
FIG. 1 illustrates a schematic of the process as described in the present application.

The various configurations of this novel hydrocarbon desulfurization process will be understood further with reference to the drawing. In FIG. 1, a liquid feed stream containing organosulfur species is introduced into the system through line 100. Metallic sodium dissolved in a solvent, preferably, liquid anhydrous ammonia. The solvent/sodium solution is introduced into the feed stream through line 101 at a temperature and pressure so that the solvent remains in the liquid phase. A temperature in the range of about 25° C. to the melting point of metallic sodium (97.81° C.) is preferred, but temperatures a low as 0° C. could be employed. For the remainder of the description, we will assume that liquid anhydrous ammonia is the solvent.

Sodium is well known to be very soluble in liquid ammonia (U. Schindewolf, *Angew. Chem. Internat. Edit., Vol.* 7 (1968)/No. 3) with solubilities as high as 6 M (approximately 20 wt %) possible. Therefore, the preferred concentration of sodium in ammonia for the present invention is 0.1 to 20 wt %, more preferably 0.5 to 20 wt % and most preferably 1.0 to 20 wt %. The formation of the sodium/ammonia solution can be assisted by using small pieces of sodium metal and using agitation, such as that provided with ultrasonic mixing, to assist in forming the desired solution.

The use of a solvent such as liquid ammonia is a critical part of the current invention. By introducing the metallic sodium into the hydrocarbon feed as a solution, the problems associated with formation of a sodium sulfide "crust" on molten sodium droplets used in the prior art is mitigated. It is highly desirable that the solvent be anhydrous (i.e., free of water), since water contained in the solvent would react readily with metallic sodium thus forming sodium hydroxide, which is not effective for removal of sulfur from organosulfur species.

The temperature of the solution of sodium in ammonia should be approximately 25° C. to minimize the total pressure. Temperatures higher than 25° C. can be employed but require the use of higher pressures in order to maintain the ammonia in the liquid phase. However, it is desired that the temperatures remain below the critical temperature of ammonia (132.6° C.) since sodium is not as soluble in supercritical ammonia as in liquid ammonia. Prior to introduction of the ammonia/sodium solution into the feed, it may be desirable to introduce ammonia into the feed, shown by reference 100A in FIG. 1, at the temperature near that of the feed, such as with the use of a static mixer. It is believed such addition will improve the ability of the feed to mix with the ammonia/sodium mixture.

The stoichiometric molar ratio of sodium to feed sulfur is 2:1, corresponding to the composition $Na_2S$. However, slightly higher ratios may be needed (such as 2.1:1) to account for inherent inefficiencies in the process, such as some sodium failing to contact an organosulfer molecule. Feed mixed with liquid ammonia/sodium solution is then fed through line 102 into a separator vessel 1, which is maintained at a pressure below the vapor pressure of ammonia at the desired operating temperature (the preferred operating temperature is in the range of 25° C. to 95° C.), and thus provides a means for removal of the ammonia by vaporization It is preferred that the vapor pressure of the feed/solvent solution entering the vessel be higher than that of the feed/sodium composition exiting the vessel 1. The pressure drop results in the flashing of ammonia and produces a feed combined with finely divided, extremely small (i.e., microparticulate or nanoparticulate) sodium particles well distributed throughout the feed. Because of their size, these sodium particles have a much smaller volume than larger droplets of liquid sodium employed in the processes of the prior art, however, due to the lack of a sodium sulfide skin, the effective surface area (that available for as a reactant surface) of these particles is greater than that available from a comparable amount of liquid sodium droplets used in the prior art processes. Ammonia removed from the feed exits through line 103 and the remaining feed containing finely divided sodium exits through line 104. It is desired that the temperature of stream 104 be lower than the melting point of sodium, thereby eliminating coalescence of sodium droplets prematurely. Flashing at temperatures above the melting point of sodium may increase the potential for sodium to coalesce in the resulting feed 104.

Hydrogen gas is then introduced into the feed stream through line 105 and the mixed hydrogen/feed stream containing finely divided sodium is fed through line 106 into the desulfurization reactor 2. Hydrogen pressure in the present invention is significantly lower than in catalytic hydrotreating systems (about 800–1500 psig) and the chemistry of desulfurization of sulfur compounds with metallic sodium also results in significantly lower hydrogen consumption than in hydrotreating methods. The preferred hydrogen pressure is from about 25 psig to about 500 psig, more preferably from about 50 psig to about 400 psig and most preferably from about 100 psig to about 300 psig.

Stream 106 will need to be heated to reaction temperature prior to entering reactor 2. The feed stream containing sodium and hydrogen is held at reaction temperature for a sufficient length of time to promote the reaction between metallic sodium and organosulfur species. The desired temperature and pressure will depend on the particular organosulfer constituency of the feed, and the reaction time will depend upon the temperature and pressure chosen. For many reactions, a reaction time in the range of 5 minutes to 60 minutes may suffice. Consider an example of the reaction between metallic sodium and a selected organosulfur compound, dibenzothiophene, is shown below:

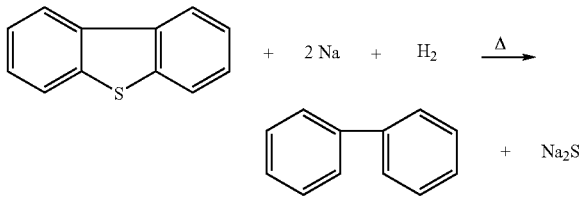

The reaction between sodium and organosulfur species occurs readily over a wide range of temperatures and can be shown to be highly thermodynamically favored at all temperatures between 25° C. and 350° C. Dibenzothiophene has been desulfurized by sodium at 150° C. to produce 99% biphenyl as the product (Z. Yu et al., *Energy and Fuels,* 1999, 13, 23–28), while most of the prior art previously cited previously carried out the desulfurization reactions at higher temperatures. Therefore, the preferred range of operating temperatures for desulfurization by the present invention is from 25° C. to 350° C., more preferably from 100° C. to 350° C. and most preferably from 200° C. to 350° C. The preferred reaction temperature may exceed the melting point of sodium and hence raise the potential for sodium to coalescence within the feed prior to reaction with the organosulfur portion of the hydrocarbon. This can be minimized by choosing the reaction temperature/pressure to reduce the residence time of the feed in vessel 2, and, upon introduction or immediately prior to the introduction of the feed/sodium mixture into vessel 2, to rapidly heat the feed/sodium mixture temperature to the desired temperature. The desired temperature of the reactants can be less than that within the reactant vessel 2 as the desulfurization reaction is exothermic, and hence, once the reaction begins, a temperature rise in the vessel 2 will occur. In certain process conditions, cooling of the reactant vessel may be desired.

It is also well known in the art that chemical reactions involving metallic sodium and organosulfur species occur more slowly at lower temperatures and more rapidly at higher temperatures; however, this may be a result of decreased available surface area of reactive sodium, which limitation the present invention does not have. For the present invention, therefore, preferred reactor residence times range from about 5 minutes to 240 minutes, more preferably from about 5 minutes to 120 minutes and most preferably from about 5 minutes to 60 minutes. Longer residence times result in increased capital cost because of the required larger reactor vessels.

Removal of sulfur from organosulfur species is also dependent on the hydrogen pressure. While desulfurization can be achieved under an inert atmosphere such as nitrogen, char formation (a coke precursor) is favored in that case (H. W. Sternberg et al, *Ind. Eng. Chem, Proc. Des. Dev.*, 13(4), 1974, 433–436). Therefore, use of a hydrogen atmosphere is preferred, but a hydrogen donor solvent (a "solvent" in the sense of the hydrogen donor solvent being substantially miscible in the hydrocarbon feed) could also be utilized, such as tetra-hydronaphtalene or tetra-hydroquinoline. Additionally, a combination of hydrogen gas and a hydrogen donor solvent could be used. Hydrogen gas or a hydrogen donor solvent, alone or in combination, will be considered a "hydrogen donor." Enough hydrogen to stabilize those molecules containing the sulfur is required. For instance, when the hydrogen donor is hydrogen gas alone, only one mole of hydrogen gas ($H_2$) per mole of sulfur is stoichiometrically required (again, slightly higher amounts of hydrogen may be needed to account for inherent inefficiencies in the process). Therefore, the present invention saves a significant amount of hydrogen over what is consumed in catalytic hydrotreating. As a result, the preferred hydrogen pressure for the present invention is 25 psig to 1000 psig, more preferably 50 psig to 500 psig and most preferably 50 psig to 300 psig.

Desulfurized feed now containing sodium sulfide ($Na_2S$) exits reactor 2 through line 107 and is cooled to a temperature below the critical temperature of the solvent (in the case of ammonia 132.7° C.) and fed to extraction vessel 3. Liquid solvent, which may be liquid ammonia (either from line 103 after compression or fresh liquid ammonia) or another suitable solvent, is added to the extractor through line 109 and flows countercurrent to the feed to remove sodium sulfide. A solvent stream containing extracted sodium sulfide exits through line 110 and desulfurized product exits through line 108. In extractor 3 the solvent to feed ratio is adjusted to obtain the optimum performance, which is known to those skilled in the art. Further, the feed may be introduced at the top or the bottom of extractor 3 depending on the relative density of the feed versus the extraction solvent.

It will also be recognized to those skilled in the art that the sodium sulfide reaction product may be removed by ordinary filtration, centrifugation or other means; however, these techniques are not expected to produce the quantitative removal of sodium sulfide achieved by extraction into liquid ammonia or a similar solvent.

As described in the preferred embodiment, the hydrogen donor, in the form of hydrogen gas, is introduced in the process stream at the reactor vessel 2. In addition, the hydrogen donor could be introduced into liquid hydrocarbon feed stream prior to the separation chamber reaction (flashing) such as by mixing with the feed stream prior to mixing with the sodium/solvent solution, or after mixing with the solution. The hydrogen donor temperature should be close to that of the liquid stream, and the pressure of addition (for hydrogen gas) could be between 5 and 200 psig, more preferably between 20 and 200 psig and most preferably between 100 and 200 psig. The molar ratio of donatable hydrogen to feed sulfur should be in at least 1:1 and up to about 2:1. Alternatively, the hydrogen donor, generally in the form of hydrogen gas, could be mixed with the solvent/sodium solution (to the solvent prior to the introduction of the sodium).

A preferred method of desulfurization of hydrocarbons using the techniques of the invention is to regenerate the sodium from the sodium sulfide contained in the stream exiting through line 110. This could be performed continuously, semi-continuously, or in batch mode. Preferably, a sodium-sulfur cell might be used, as described in assignee's published U.S. patent application 2002172871, published Nov. 21, 2002, incorporated herein by reference. The cell described in the published U.S. application is a secondary battery, meaning that it can be recharged. To charge the battery, it is necessary to apply a potential (approximately 2.1 V), which results in the production of elemental sodium as a product. The method envisions feeding sodium sulfide ($Na_2S$) or, alternatively, sodium polysulfide ($Na_xS_x$, where x=3–5) to the battery where the reverse reaction occurs electrochemically generating sodium. One problem is that sodium sulfide ($Na_2S$) melts at >1000° C. and therefore would be a solid at normal operating conditions. One solution is to use liquid ammonia as the solvent for $Na_2S$ in the battery. The solubility of $Na_2S$ is quite good in liquid ammonia at temperatures ranging from 20° C. to approximately 110° C. and liquid ammonia has the benefit of being electrically conductive making it an excellent solvent of choice for this system.

What is claimed is:

1. A method of removing sulfur from a liquid hydrocarbon feed, the method comprising the steps of:

(a) dissolving metallic sodium in a solvent to form a solution;

(b) combining said solution with a liquid hydrocarbon feed to form a first combined stream, said liquid hydrocarbon feed having a portion comprising at least one organosulfur species, and said step of combining occurring at a first desired temperature and at a first desired pressure, said first desired pressure being above the vapor pressure of said solvent at said first desired temperature;

(c) lowering the pressure of said first combined stream sufficiently to achieve vaporization of a substantial amount of said solvent from said first combined stream to produce a second composition;

(d) combining said second composition with a hydrogen donor to form a third composition;

(e) reacting said third composition for a sufficient time and at a sufficient temperature to form a fourth composition comprising a modified liquid hydrocarbon product containing sodium sulfide and a reduced amount of said organosulfur species; and (f) extracting a substantial amount of said sodium sulfide from said fourth composition leaving a modified liquid hydrocarbon product.

2. The method of claim 1 wherein said step (f) is preceded by the step of cooling said fourth composition.

3. A modified liquid hydrocarbon product produced from the process of claim 2.

4. The method of claim 1 wherein said solvent is anhydrous ammonia.

5. The method of claim 1 wherein said first temperature is at or below the melting point of metallic sulfur.

6. The method of claim 1 wherein said first temperature is about 25° C.

7. The method of claim 1 wherein said sufficient time in step (e) is about 5 minutes to about 60 minutes.

8. The method of claim 1 wherein said sufficient temperature in step (e) is in the range of about 25° C. to 350° C.

9. The method of claim 8 wherein said sufficient temperature in step (e) is in the range of about 200° C. to 350° C.

10. The method of claim 1 wherein said extraction step includes the step of introducing a solvent for said sodium sulfide into said fourth composition.

11. The method of claim 10 wherein said solvent is ammonia.

12. The method of claim 1 wherein step (b) has a molar ratio of sodium to sulfur, wherein said molar ration of sodium to sulfur is in the range of about 2.5:1 to 2:1.

13. The method of claim 1 wherein said hydrogen donor comprises hydrogen gas or a hydrogen donor solvent.

14. A method of removing sulfur from a liquid hydrocarbon feed, the method comprising the steps of:

(a) dissolving metallic sodium in a solvent to form a solution;

(b) combining a liquid hydrocarbon feed with a hydrogen donor to form a first combined stream, said liquid hydrocarbon feed having a portion comprising at least one organosulfur species;

(c) combining said first combined stream with said solution to form a second combined stream, said step of combining occurring at a first desired temperature and at a first desired pressure;

(d) lowering the pressure of said second combined stream sufficiently to achieve vaporization of a substantial amount of said solvent from said second combined stream thereby producing a third composition;

(e) reacting said third composition for a sufficient time and at a sufficient temperature to form a fourth composition containing sodium sulfide and a reduced amount of said organosulfur species; and (f) extracting a substantial amount of said sodium sulfide from said fourth composition leaving a modified liquid hydrocarbon product.

15. A modified liquid hydrocarbon product produced from the process of claim 14.

16. The method of claim 14 wherein said solvent is anhydrous ammonia.

17. The method of claim 14 wherein said first temperature is at or below the melting point of metallic sodium at said first desired pressure ° C.

18. The method of claim 14 wherein said first temperature is about 25° C.

19. The method of claim 14 wherein said sufficient time in step (e) is about 5 minutes to about 60 minutes.

20. The method of claim 14 wherein said sufficient temperature in step (e) is in the range of about 25° C. to 350° C.

21. The method of claim 14 wherein said extraction step includes the step of introducing a solvent for said sodium sulfide into said fourth composition.

22. The method of claim 14 wherein step (c) has a molar ratio of sodium to sulfur and said molar ratio of sodium to sulfur is in the range of about 2.5:1 to 2:1.

23. The method of claim 14 wherein said hydrogen donor comprises hydrogen gas or a hydrogen donor solvent.

* * * * *